US007290766B2

(12) United States Patent
Roberts

(10) Patent No.: US 7,290,766 B2
(45) Date of Patent: Nov. 6, 2007

(54) THREE DIMENSIONAL PIECE ALIGNMENT GAME

(76) Inventor: Ronald Roberts, 528 Elizabeth Dr., Eaglesville, PA (US) 19403

( * ) Notice: Subject to any disclaimer, the term of this patent is extended or adjusted under 35 U.S.C. 154(b) by 15 days.

(21) Appl. No.: 11/055,937

(22) Filed: Feb. 11, 2005

(65) Prior Publication Data

US 2005/0179200 A1 Aug. 18, 2005

Related U.S. Application Data

(60) Provisional application No. 60/544,707, filed on Feb. 13, 2004, provisional application No. 60/602,471, filed on Aug. 18, 2004.

(51) Int. Cl.
*A63F 3/00* (2006.01)

(52) U.S. Cl. ..... 273/241; 273/290

(58) Field of Classification Search ..... 273/241, 273/260, 261, 290, 264
See application file for complete search history.

(56) References Cited

U.S. PATENT DOCUMENTS

| | | | | | |
|---|---|---|---|---|---|
| 1,465,160 | A | * | 8/1923 | Di Luchio | 273/264 |
| 4,364,568 | A | * | 12/1982 | Tracy | 273/242 |
| 4,456,261 | A | * | 6/1984 | Daitzman | 273/271 |
| 4,651,996 | A | * | 3/1987 | Watkins, Jr. | 273/271 |
| 5,265,885 | A | * | 11/1993 | Blount | 273/348.3 |
| 5,318,305 | A | * | 6/1994 | LoCoco | 273/258 |
| 5,328,188 | A | * | 7/1994 | Brotz | 273/239 |
| 5,839,727 | A | * | 11/1998 | Stillinger | 273/271 |
| 6,062,562 | A | * | 5/2000 | Pardee | 273/248 |

* cited by examiner

*Primary Examiner*—Vishu K. Mendiratta
(74) *Attorney, Agent, or Firm*—William H. Eilberg

(57) ABSTRACT

A game including a playing area divided into a plurality of spaces, and sets of game pieces with each set associated with different players or teams. The players or teams execute strategically selected instructions, such as move, stack and flip, to position their game pieces in the spaces. The first player or team to place their game pieces on spaces such that top game pieces of stacks form a predetermined design, such as a vertical, horizontal or diagonal row, wins the game. The game allows players flexibility to select rules to adjust the skill level of the game.

3 Claims, 6 Drawing Sheets

THREE DIMENSIONAL PIECE ALIGNMENT GAME

PRIORITY

This application claims the benefit under 35 USC 119(e) of both U.S. Provisional Application No. 60/544,707 entitled "Board Game" which was filed on Feb. 13, 2004 and for which Ronald Roberts was an inventor, and U.S. Provisional Application 60/602,471 entitled "Board Game" which was filed on Aug. 18, 2004 and for which Ronald Roberts was an inventor.

BACKGROUND

Various games have been developed which involve movement of game pieces along a board. Some of these games involve moving pieces according to specific rules or employ the use of random generators (dice or spinners). Games may progress due to shear chance from the random generator or require complex strategies involving different types of movements from varying pieces. The complexity of the different pieces making different moves may make the game too complex for children.

Other games may involve a central theme and a high degree of interaction among the players. These games may not require the use of strategies related to the movement of game pieces.

A game requiring strategy for the movement of pieces as well as interaction with other players is desired. A game that can have the level of complexity easily reduced so that the game can be enjoyed by children as well as adults is also desirable.

SUMMARY

A game is disclosed that can be played and enjoyed by both adults and children. The game may be played with between two and four players or teams. The game may include a board with undifferentiated spaces made in any shape and ordered in any pattern. The game includes sets of game pieces that are distinguished from each other by any manner of indicia. Players take turns executing any one of a series of instructions with the goal of orienting a predefined number of their assigned game pieces in a predefined pattern, such as consecutively in either a vertical, horizontal, or diagonal line.

The instructions allow players to place, relocate, stack, invert, or reorient the games pieces within prescribed guidelines to accomplish this goal. The first player to achieve this pattern with their pieces wins the game. The game allows players flexibility to select rules to adjust the skill level of the game. The game can be sized for travel, played in tournament style, or computerized in a hand held device or network.

BRIEF DESCRIPTION OF THE DRAWINGS

The features and advantages of the various embodiments will become apparent from the following detailed description in which.

DETAILED DESCRIPTION

Figure 1:
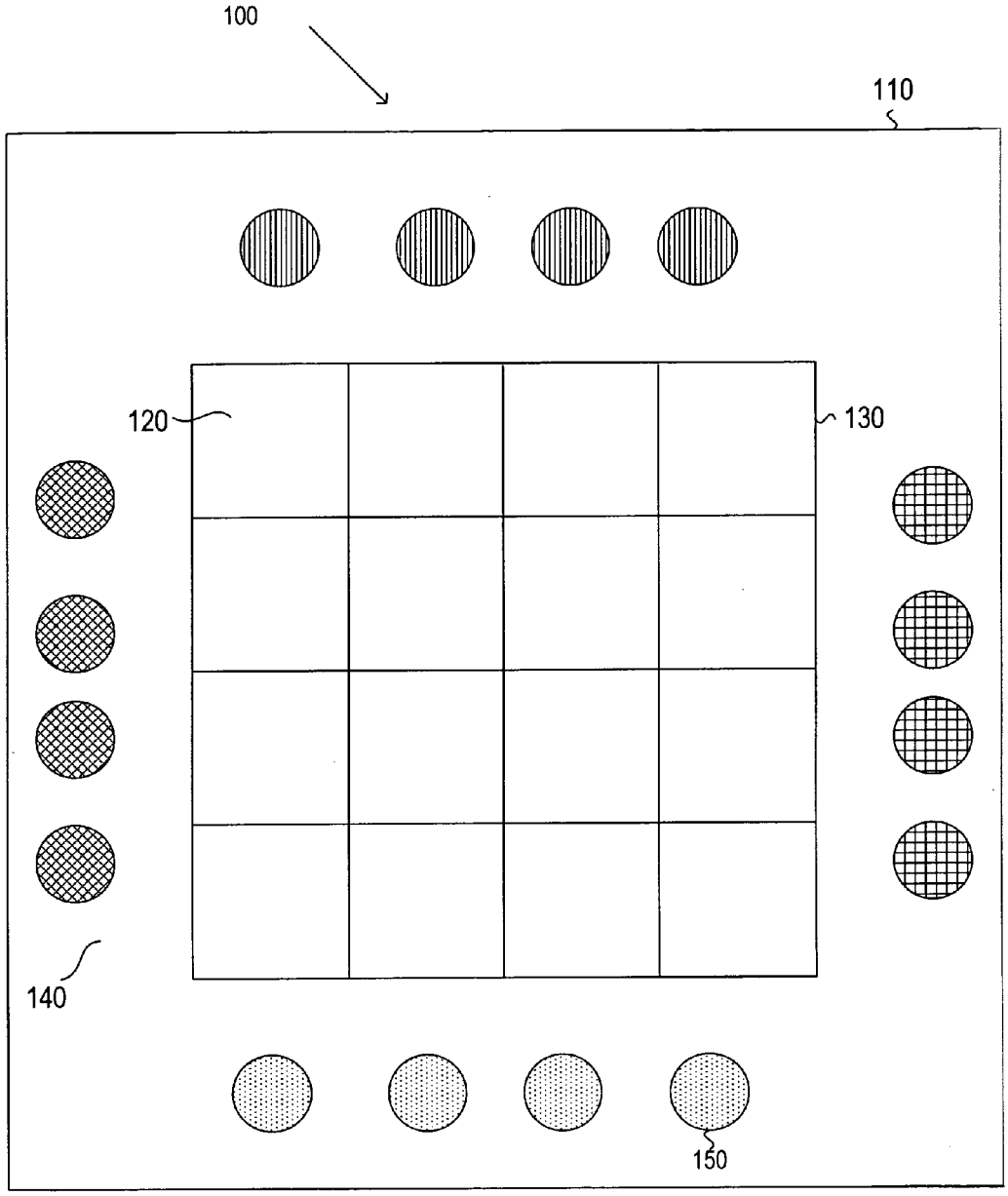
FIG. 1 illustrates an exemplary game board, according to one embodiment.

FIG. 1 illustrates an exemplary game board 100 that can be used to play various embodiments of a game described herein. The game board 100 has an exterior boundary 110 (e.g., outer edge or edges) forming a game board shape (e.g., square). The game board 100 is divided into a number (e.g., sixteen) of undifferentiated spaces 120 (e.g., squares). The collection of undifferentiated spaces 120 makes up a playing area 130 (e.g., square). The playing area 130 may encompass the entire game board 100 or a portion thereof. The game board 100 may include one or more home base areas 140. The home bases 140 may be located outside the playing area 130 (e.g., directly next to edges of the playing area 130). Alternatively, players could create home base areas off of the game board 100 (e.g., along the edges of the game board, wherever is convenient for the players).

As illustrated, the exemplary game board 100 has a square playing area 130 made up of 16 undifferentiated square spaces 120. The game board 100 is not limited by the illustrative embodiment. Rather various parameters (e.g., the size and shape of the game board 100; the size, shape, layout, or number of undifferentiated spaces 120; the location of the home bases 140) could be changed without departing from the scope. The game board 100 need not be planar and may be formed with spaces offset from each other in all three dimensions.

According to one embodiment, the game board 100 is made of a semi-rigid material (e.g., cardboard). According to one embodiment, the game board 100 is made of a smooth material (e.g., vinyl). However, as one skilled in the art would recognize the type of material is not limited to rigid or smooth materials or any specific material as any material could be used for the game board 100 without departing from the scope of the various embodiments described herein. According to one embodiment, the ground (e.g., grass, parking lot, tennis court, sand) may be used as a game board with undifferentiated spaces being marked on the ground (e.g., paint, marker, tape, rope). According to one embodiment, the game board could be generated on a computer screen.

According to one embodiment, the spaces 120 on the game board are undifferentiated from one another. The spaces do not require any particular coding or marking for the game to be played. However colors, letters, numbers, distinctive patterns, distinctive characters, distinctive images or other indicia that differentiate the spaces from each other for ease of identifying certain movements on the board may code the spaces. According to one embodiment, the spaces on the board are square. However, the spaces are not limited thereto and could be any shape (e.g., circle, rectangle, triangle). According to one embodiment, the spaces are symmetrical in shape. However, the spaces are not limited thereto. The orientation of the spaces 120 on the game board 100 need not be limited to a grid. For example, the spaces 120 could be oriented in a spiral pattern or interwoven triangular matrix.

The home bases 140 may have different patterns. The patterns for the home bases 140 may be associated with the patterns for the game playing pieces 150. Each player's game playing pieces 150 could start out in the associated home base area 140 (e.g., blue game pieces 150 would start in the blue home base 140). However, the game is not limited by the type of code used to identify the home base 140 and there need be no association between the home bases 140 and the game pieces 150. According to one embodiment, the home bases 140 are devices separate from the game board 100 (e.g., containers, holders) for holding the game pieces and can be placed wherever the player desires.

The game pieces 150 can be any size, shape, thickness or and made of any material as long as they fit within the undifferentiated spaces 120 on the game board 100. The game pieces 150 also should be capable of being stacked on top of one another. According to one embodiment, the game pieces 150 are flat and circular (e.g., chips). Each set of game playing pieces 150 has a unique code, which may be a pattern, a color, a letter, a number, a shape, an image or any combination of the foregoing, or any other indicia for distinguishing one set of game pieces (e.g., players) from another. Each set of game pieces 150 would be associated with a different player (or team). A set of game pieces 150 may include one for each undifferentiated space 120 (e.g., 16).

The object of the game is to be the first player (or team) to align a predetermined number (e.g., three) of game pieces 150 in a predefined pattern. The predefined pattern may be game pieces lined in a consecutive vertical, horizontal, or diagonal row on the game board 100. The predefined pattern may be selected from a set of patterns for the particular game board configuration. The predefined pattern may be selected by the players. For example, patterns for the exemplary game board 100 may include a letter L (a specific two edges of the game board, or any two edges connected at a corner), a letter X (two lines starting and ending in opposite diagonal corners), or an outside edge. Game pieces 150 may be stacked upon one another so the predefined pattern may be created by looking at the top pieces in each undifferentiated space 120.

According to one embodiment, between two players (and/or teams) and four players (and/or teams) may play the game. Game play entails players taking turns making any one of a number of defined moves. According to one embodiment, players choose their moves based on strategy. The strategy of which move to make may depend on the outcome of that move in reaction to the circumstances under which the move was made and the possible actions of other players based on the move.

According to one embodiment, it is possible to select a type of move that a player makes based on a device (e.g., a spinner, die/dice, card(s)). If the player can not make the specific move assigned due to the configuration of the game at that point, then the player may either get to select another move, forfeit their turn, or get to select another move but have some type of penalty assigned. If the player can make the move but it will lead to an undesired result, the player may either have to make the move, may be able to opt for another move, or may be able to opt for another move only after having some type of penalty assigned.

Each player is assigned a set of game playing pieces 150 prior to starting the game. As previously noted, the game pieces 150 will be distinguished from one another via some indicia (e.g., color, pattern, number). The players may place their pieces 150 on or in their respective home bases 140.

A determination is made as to which player goes first and in what order they will proceed thereafter. The first player may be chosen amongst the players according to any criteria desired (e.g., age, height, game piece indicia) or alternatively decided by using any random generation method (e.g., die/dice, spinner, card(s)). The order of play may be any order desired by the players or may be random. For ease of remembering the order as play proceeds it may be beneficial if the players were organized (e.g., clockwise, counter clockwise) based on the order in which play proceeds from one player to the next. On each turn, a player executes one instruction (move type) from a predetermined selection of all possible instructions. The various instructions that a player may execute are described below.

When describing how to play the game and the various instructions (moves) that the player can utilize specific reference will be made to the embodiments described with respect to FIG. 1. That is a game consisting of a square game board containing 16 square spaces; four individuals or teams having unique game pieces (when described herein the different indicia of pieces will be referred to as dots, lines, Xs, and crosses for consistency and ease of understanding); and a home base associated with each individual or team that is located adjacent to an edge of the game area. The use of these embodiments is simply for ease of explanation and should not in any way be construed to limit the scope of the various embodiments of the game described herein.

Figure 2:
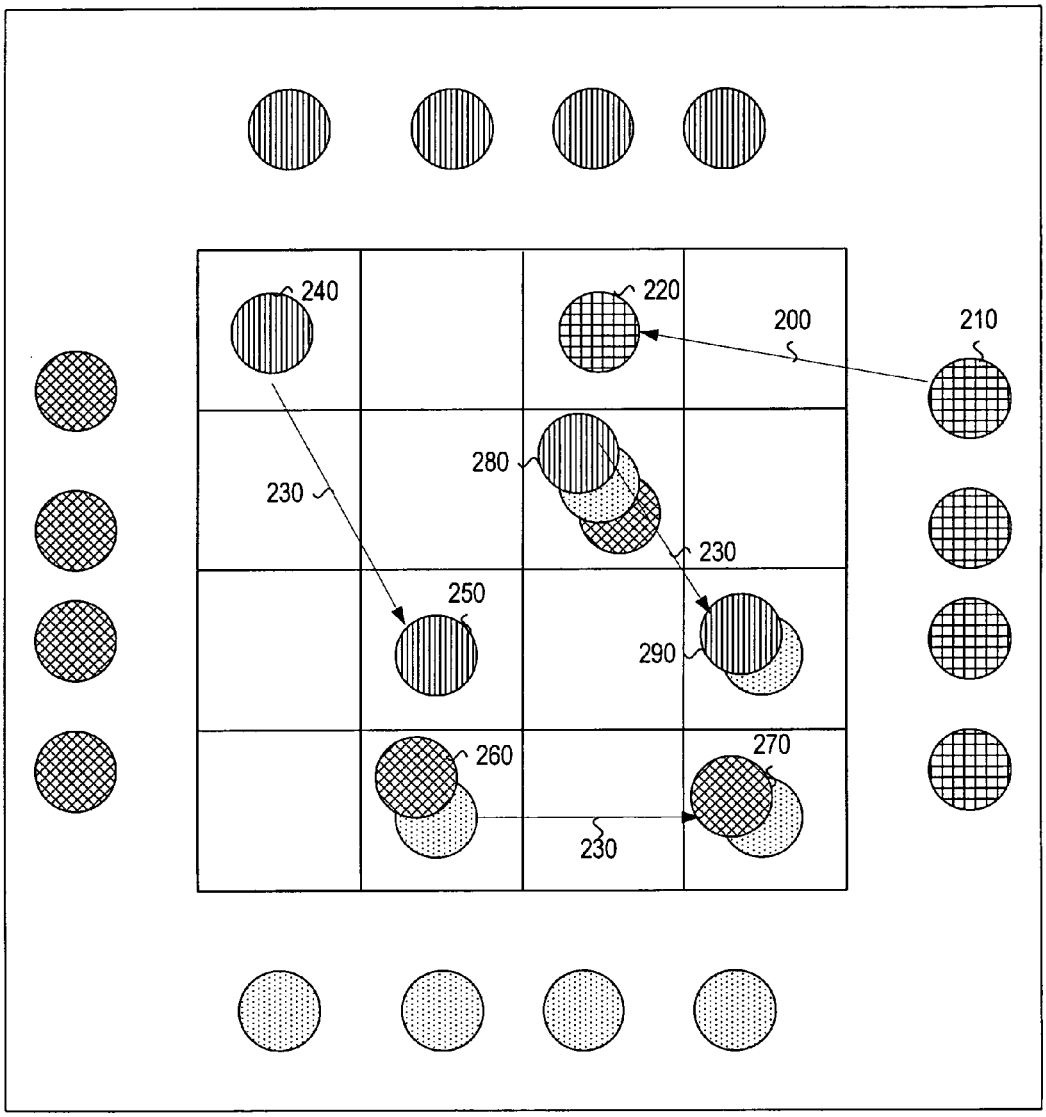
FIG. 2 illustrates several exemplary uses instructions that entail moving pieces to open (unoccupied) spaces on a game board, according to one embodiment.

FIG. 2 illustrates several exemplary instructions that entail moving pieces to open (unoccupied) spaces on the game board. An in-play instruction 200 entails a player taking one of their game pieces from their home base and placing it on any unoccupied space on the game board. An exemplary in-play instruction 200 is illustrated moving a game piece from the home base 210 onto an open space 220.

A move instruction 230 entails a player moving a game piece (or a stack of game pieces) from a current location on the game board to an unoccupied space on the game board. According to one embodiment, this move could be limited to the player's own game piece or a stack that has the player's game piece on top. According to an alternative embodiment, this move could be made on any previously played game piece or stack of game pieces regardless of which player's game pieces they are. An exemplary move instruction 230 is illustrated moving a single game piece from a current space 240 to an open space 250. An exemplary move instruction 230 is illustrated moving a stack of game piece (e.g., 2) from a current space 260 to an open space 270.

According to one embodiment, a portion of one stack (e.g., top piece from 3 piece stack) may be moved. An exemplary move instruction 230 is illustrated moving two of three pieces of a stack from a current space 280 to an open space 290. The third piece (the X) would remain at the current location 280.

Figure 3:
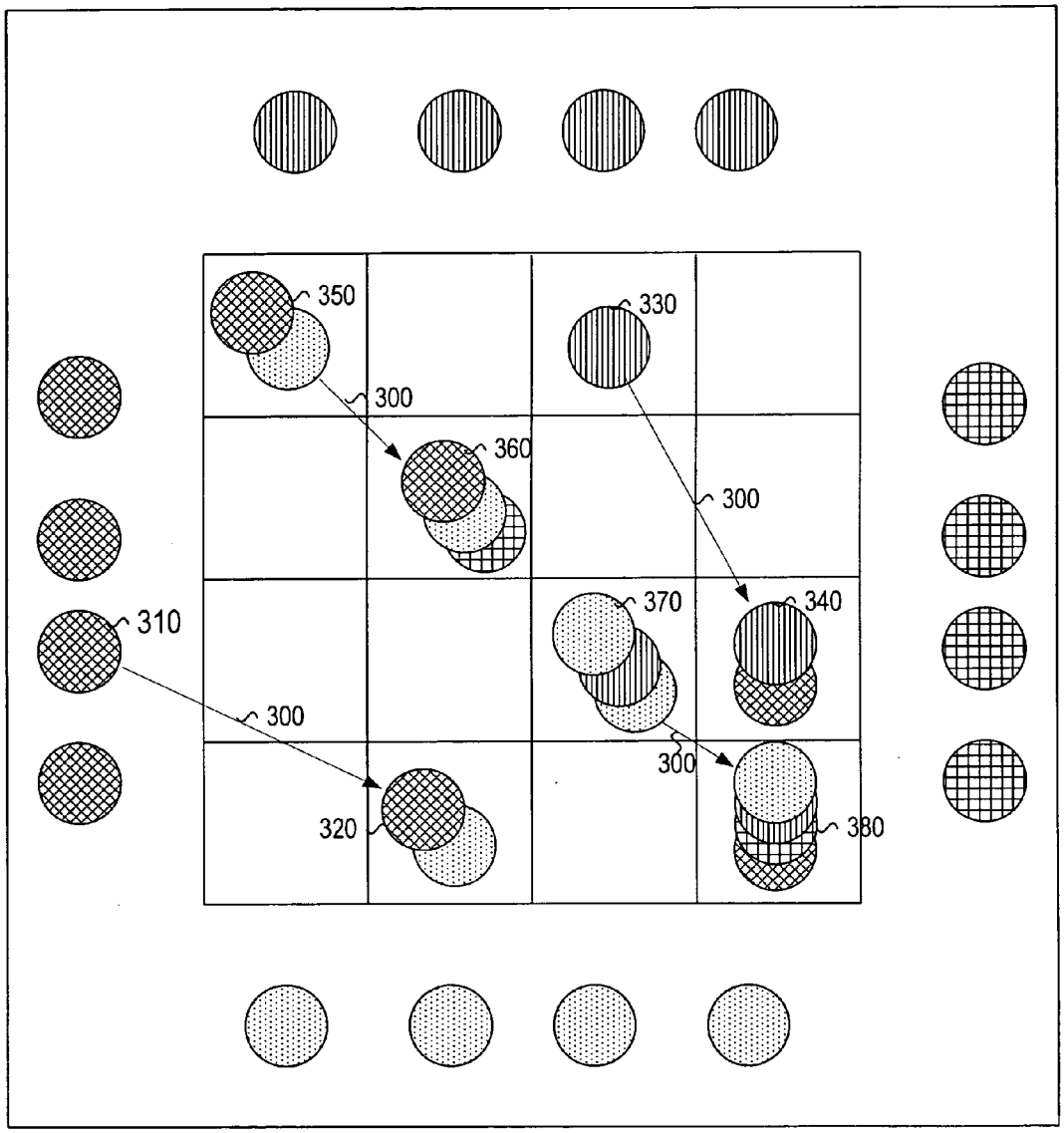
FIG. 3 illustrates several exemplary instructions that entail moving pieces onto other game pieces, according to one embodiment.

FIG. 3 illustrates exemplary instructions that entail moving pieces onto other game pieces. A cover instruction 300 entails a player moving a game piece or stack of pieces from a current location to on top of another game piece or stack of game pieces. The current location may be the players home base or it may be any space on the board. According to various embodiments, a player may only be able to move their own game pieces, may only be able to move a stack of game pieces having their piece on top, may only be able to move a stack having their game piece located therein, or may be able to move any previously played game piece or stack of game pieces regardless of which player's game pieces they are.

An exemplary cover instruction 300 is illustrated moving a game piece from the home base 310 to on top of a game piece located at space 320 (the X was placed on top of the dot). Another exemplary cover instruction 300 is illustrated moving a game piece from current space 330 to on top of a game piece located at space 340. Another exemplary cover instruction 300 is illustrated moving a stack of game piece from a current space 350 to on top of a game piece located at space 360.

According to one embodiment, a portion of one stack (e.g., top piece from a 3 piece stack) may be stacked onto another piece or stack. An exemplary cover instruction 300 is illustrated moving two of three pieces of a stack from a current space 370 onto an existing stack of two pieces at space 380. The third piece (the dot) would remain at the current location 370 and the new location 380 will include the two pieces originally located there (the lower two pieces—cross, X) and the pieces stacked on top (the top two pieces—dot, line).

Figure 4:
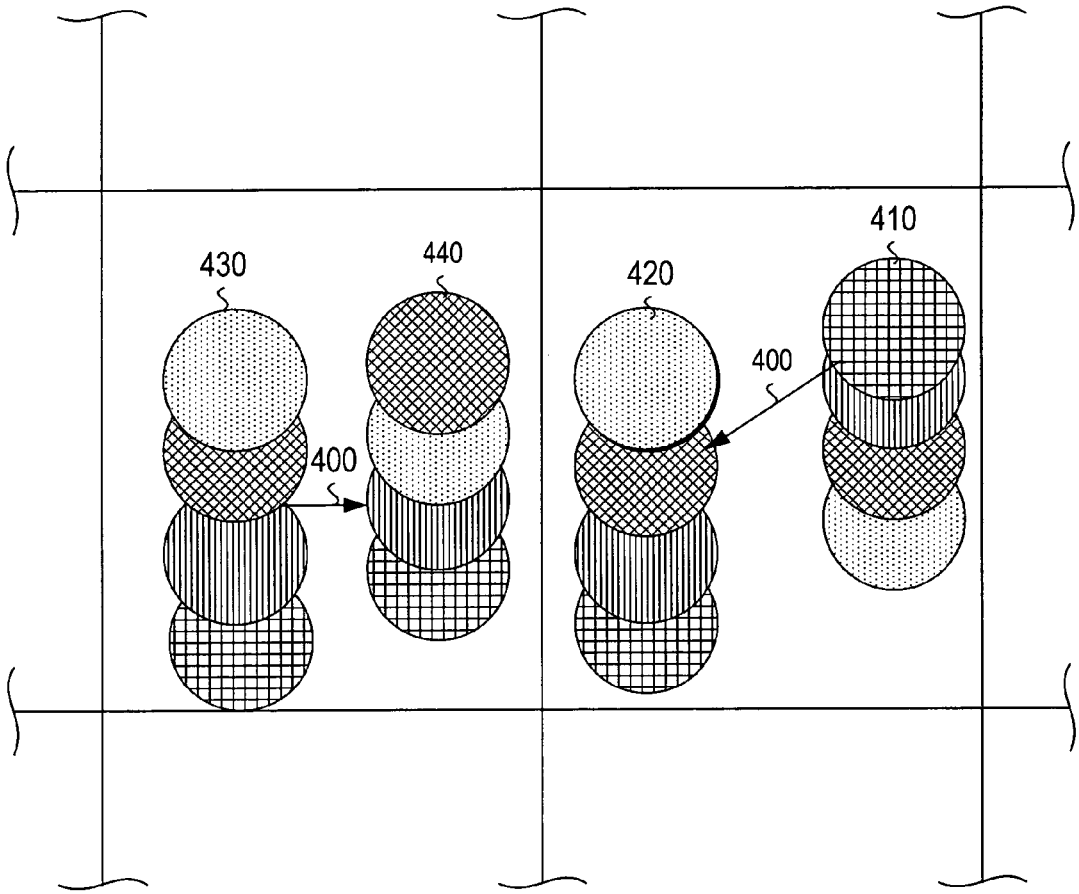
FIG. 4 illustrates exemplary instructions that entail flipping stacks of pieces, according to one embodiment.

FIG. 4 illustrates exemplary instructions that entail flipping stacks of pieces. A flip instruction 400 entails a player inverting a stack of game pieces while keeping the stack in the same space. According to various embodiments, the player may invert any stack regardless of whether their piece is located in the stack, may be limited to inverting a stack where their game piece will be affected (e.g., top or bottom of stack), or may be limited to inverting a stack that contains one of their pieces somewhere in the stack. An exemplary flip instruction 400 is illustrated flipping a stack of game pieces from a first orientation 410 (cross, line, X, dot) to a second orientation 420 (dot, X, line, cross).

According to one embodiment, a portion of the stack (e.g., top 2 pieces from a 4 piece stack) may be inverted. According to various embodiments, the player may invert any portion of a stack regardless of whether their piece is located in the portion or in the stack, may be limited to inverting a portion of a stack where their game piece will be affected (e.g., top or bottom of portion), may be limited to inverting a portion of a stack that contains one of their pieces somewhere in the portion, or may be limited to inverting a portion of a stack that contains one of their pieces somewhere in the stack (not necessarily in the portion). An exemplary flip instruction 400 is illustrated flipping a portion of a stack of game pieces (top two) so that the stack goes from a first orientation 430 (dot, X, line, cross) to a second orientation 440 (X, dot, line, cross).

Figure 5:
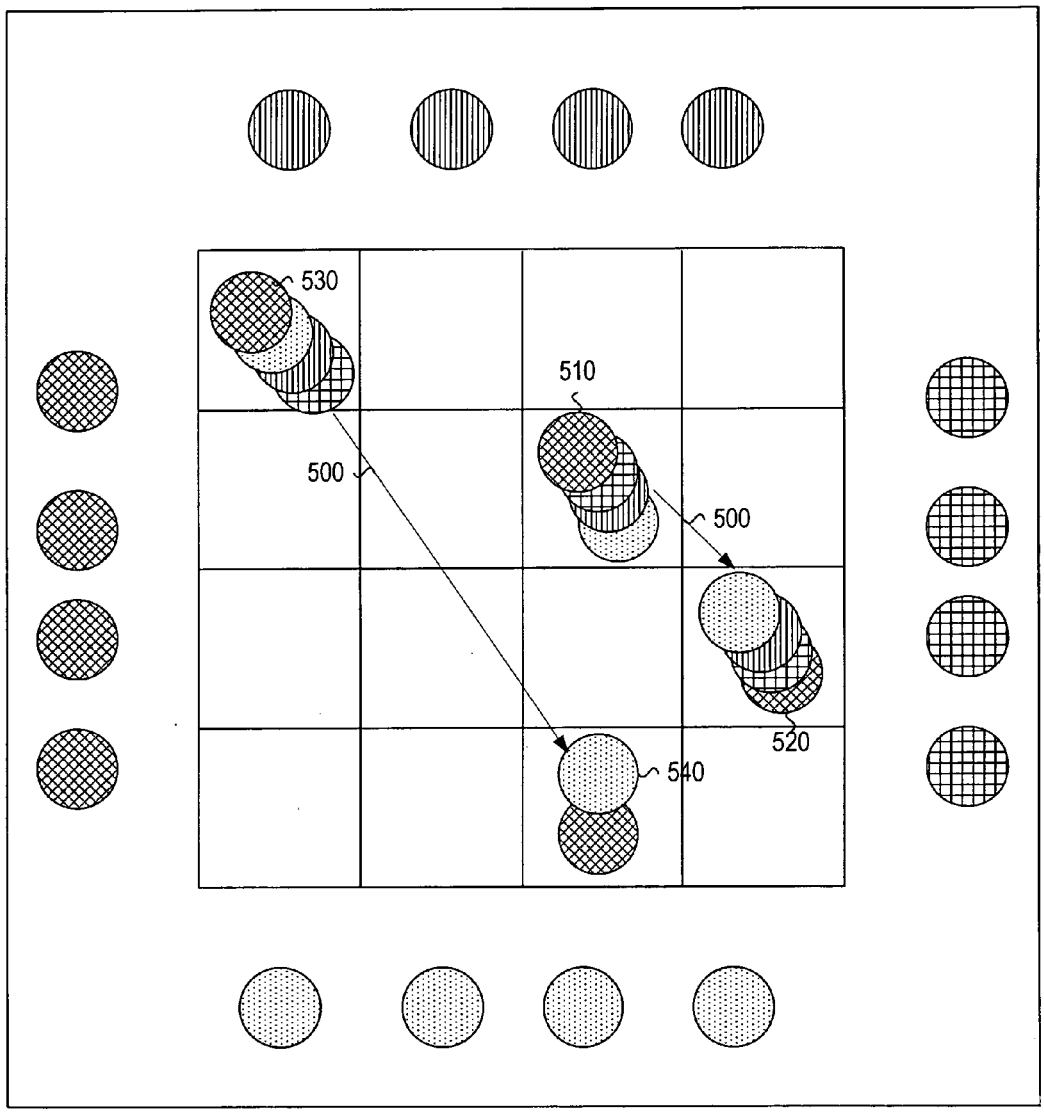
FIG. 5 illustrates exemplary instructions that entail flipping and moving stacks of pieces, according to one embodiment.

FIG. 5 illustrates exemplary instructions that entail flipping and moving stacks of pieces. A flip and move instruction 500 entails a player inverting a stack of chips and relocating the stack to a free space on the board. According to various embodiments, the player may invert and move any stack regardless of whether their piece is located in the stack, may be limited to inverting and moving a stack where their game piece will be affected (e.g., top or bottom of stack), or may be limited to inverting and moving a stack that contains one of their pieces somewhere in the stack. An exemplary flip and move instruction 500 is illustrated flipping and moving a stack of game pieces from a first location having a first orientation 510 (X, cross, line, dot) to a second location having a second orientation 520 (dot, line, cross, X).

According to one embodiment, a portion of the stack (e.g., top 2 pieces from a 4 piece stack) may be inverted and moved. According to various embodiments, the player may invert and move any portion of a stack regardless of whether their piece is located in the portion or in the stack, may be limited to inverting and moving a portion of a stack where their game piece will be affected (e.g., top or bottom of portion), may be limited to inverting and moving a portion of a stack that contains one of their pieces somewhere in the portion, or may be limited to inverting and moving a portion of a stack that contains one of their pieces somewhere in the stack (not necessarily in the portion). An exemplary flip and move instruction 500 is illustrated flipping and moving a portion of a stack of game pieces (top two—X, dot) from a first location 530 to a second location 540 (dot, X). The first location 530 is left with the lower two pieces (line, cross).

Figure 6:
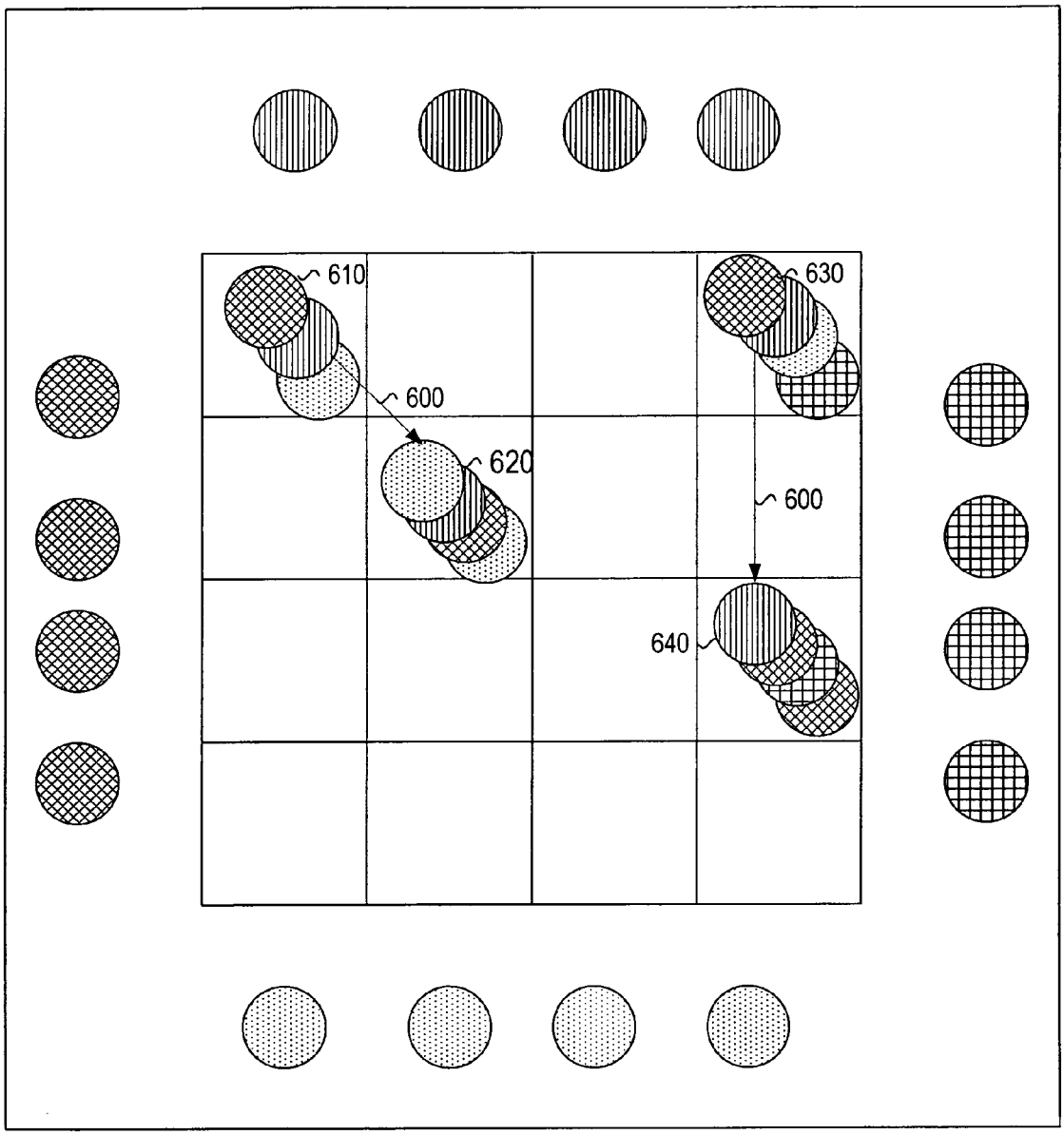
FIG. 6 illustrates exemplary instructions that entail flipping and stacking stacks of pieces, according to one embodiment.

FIG. 6 illustrates exemplary instructions that entail flipping and stacking stacks of pieces. A flip and stack instruction 600 entails a player inverting a stack of chips and stacking the flipped stack onto another piece or stack of pieces on the game board. According to various embodiments, the player may invert and stack any stack regardless of whether their piece is located in the stack, may be limited to inverting and stacking a stack where their game piece will be affected (e.g., top or bottom of stack), or may be limited to inverting and stacking a stack that contains one of their pieces somewhere in the stack. An exemplary flip and stack instruction 600 is illustrated flipping and stacking a stack of game pieces from a first location 610 having a first orientation (X, line, dot) to a second location 620 having a second orientation (dot, line, X) on top of an existing piece (dot) so that there are a total of four chips at the second location 620 (dot, line, X, dot).

According to one embodiment, a portion of the stack (e.g., top 2 pieces from a 4 piece stack) may be inverted and stacked. According to various embodiments, the player may invert and stack any portion of a stack regardless of whether their piece is located in the portion or in the stack, may be limited to inverting and stacking a portion of a stack where their game piece will be affected (e.g., top or bottom of portion), may be limited to inverting and stacking a portion of a stack that contains one of their pieces somewhere in the portion, or may be limited to inverting and stacking a portion of a stack that contains one of their pieces somewhere in the stack (not necessarily in the portion). An exemplary flip and stack instruction 600 is illustrated flipping and stacking a portion of a stack of game pieces (top two—X, line) from a first location 630 to a second location 640 having a second orientation (line, X) on top of an existing stack (cross, X) so that the new stack at the second location 640 includes a total of four chips (line, X, cross, X). The first location 630 is left with the lower two pieces (dot, cross).

According to one embodiment, there is a limit to how high the chips can be stacked (e.g., 4). Accordingly, certain instructions would not be permissible because the resulting stack would be too high. For example, a chip could not be stacked on top of stack of four chips and a stack of three chips could not be stacked on an existing stack of two chips. According to one embodiment, only one chip of each player could be included on any space on the game board. Accordingly, certain instructions would not be permissible because the resulting stack would have more than one of a certain type of game piece. For example, an X chip could not be placed on a stack that already had an X and a stack having a dot could not be flipped and stacked onto a dot game piece.

The various instructions (moves) described above may be described within instructions for the game. The game may include a reference card or cards (not illustrated) which summarize the above instructions for quick reference by each player. The instructions may be included directly on the board.

The player may execute any of the instructions identified above at any point in the game as long as the move is permissible (e.g., a free space is available to move a piece to). For example, to perform one of the "move" instructions (e.g., in-play, move, flip and move) at least one empty game piece must be available on the board.

According to various embodiments, the player may skip their turn at any point if they desire, may only skip their turn if only available instruction(s) would lead to an undesired result, must take a turn as long as there is a valid instruction available even if the outcome is not desired, or may skip a turn if willing to accept some kind of penalty.

Each player takes turns executing a game instruction and the game progresses according to the strategy selected by each player on their turn. Play continues until one player aligns their chips in the predefined pattern and is declared the winner.

The game as described in the various embodiments above can be won by developing various strategies. Although the instructions chosen by each player are determined by their own strategic choices, the game is such that at any given moment, other players may create more effective strategies that either cancel out or override the previous player's strategies. For example, a player may consider the "cover" instruction and then decide against it after considering what action the next player may take (e.g., next player may use that action to his or her advantage). The interdependence of many of the moves is such that a chain of events may occur as a result of any one move. Thus players must carefully consider the overall effects of each move during the game. Any player's decision is a strategic decision that may determine the outcome of the game.

As previously discussed, the predefined pattern may be three game pieces (e.g., top pieces in the space) aligned vertically, horizontally, or diagonally. The type of pattern selected may be selected based on the skill level of the players. For example, beginners may limit the pattern to three pieces aligned vertically, horizontally or diagonally while experts may use more complicated patters such as an X.

According to one embodiment, a time limit may be set on individual moves and/or the entire game. The time limit may be fixed (e.g., 45 seconds/move, 20 minutes/game) or may be adjusted depending on the skill level and patience of the players. A beginner version of the game may be played over a short time frame (e.g., 3 or 4 minutes). However, as players advance the playtime may increase as more time is spent strategizing (e.g., 45 minutes to finish a game among seasoned players). Conversely, a beginner version may allow a player more time to make a move (e.g., 3 minutes) while an advanced version may provide less time (e.g., 30 seconds).

The number and manner of instructions allowed may also be adjusted. For example, a basic game may have fewer moves than an advanced game (e.g., flip and move only for advanced games). Moreover, a basic game may not allow the movement and/or inverting a partial stack while an advanced game could. As one skilled in the art would understand, the rules can be modified according to the skill and desires of the players.

According to one embodiment, the game is played as a tournament comprising multiple games. The winner of the tournament can be the one who wins the largest number of games, a predetermined plurality (such as two-thirds or three-quarters) of the games, beats all challengers in a bracket type format.

Although this game is competitive in nature and players and teams do not normally collaborate with each other, in another alternative version of the game, there could be cooperation between pairs of players or teams. For example, team play can be allowed between opposite or adjacent partners. The teams may even form alliances with other teams, to enhance the competitiveness of the game. According to one embodiment, the number of teams (whether individual players or groups of players) is between two and four. In team play, members must work together to both reveal other teams' moves or strategies and to anticipate moves that they can make to maximize their own advantage.

According to one embodiment, the game board and pieces may be reduced in size to facilitate maximum portability. This version could use colored pegs, magnets, chips, or tokens on a small, undifferentiated pegboard, magnetic, or Velcro surface. According to one embodiment, a computerized version of the game could be used in which the same dynamics are involved with the use of computer graphics. Computerized versions of the game could be used on personal computers (e.g., desktop, portable), handheld devices (e.g., cell phones, PDAs, MP3 players, handheld games such as Gameboy®), or gaming systems (e.g., Xbox®, PlayStation®, GameCube®). The computerized versions could be standalone or could be networked so that multiple players can be linked. The computerized versions may enable a player or players to play against a software program acting as a player or players.

According to one embodiment, a large version of the game can be produced where the game board may be a big mat (e.g., vinyl) placed on the ground and the game pieces are large (e.g., foam pieces, bean bags). The large game could be used for team building or could be used by children (e.g., similar size to a twister game board). For the large version, teams may dress in similar outfits (e.g., colors) and use themselves as the game pieces. According to one embodiment, the game can be played on a pad of paper using a pencil and eraser.

According to one embodiment, different versions of the game could be produced for different entities and incorporate that entity into the game (much like the various versions of Monopoly). For example, the game pieces could capture different aspects of the entity. If the game was produced for professional sports leagues the different game pieces could be different teams. If the game was produced for a cartoon, television show or movie the game pieces could be related to the different characters. Also, the game board could be modified to reflect the entity. For example, if the game was produced for a football league (e.g., NFL®) the game board could be based on a football field and the pattern may be to get your pieces across a certain line to symbolize a touchdown or field goal.

The game has been described with reference to specific embodiments but is not limited thereto. As one skilled in the art would recognize, numerous modifications could be made to the configuration of the game or play of the game, without departing from the scope of the various embodiments described herein. Rather, the embodiments of the game are intended to be defined within the spirit and scope of the following claims.

What is claimed is:

1. A method of playing a game, comprising:

a) providing a playing area having a plurality of spaces, b) associating players with game pieces, wherein each player is associated with a different set of game pieces, c) taking turns moving game pieces, wherein, on each turn, a player moves a game piece according to one of the following actions:

i) placing a game piece on an empty space on the playing area, ii) placing a game piece on top of a game piece, or stack of game pieces, of another player, provided that taking this action does not create a stack of game pieces which contains more than a predetermined limit of game pieces, iii) moving a game piece, already on the playing area, or a stack of game pieces, already on the playing area, to an empty space on the playing area, or onto a stack of game pieces, provided that taking this action does not create a stack of game pieces which contains more than a predetermined limit of game pieces, iv) flipping a stack of game pieces already on the playing area, such that an order of game pieces forming the stack becomes reversed, and d) determining a winner based on which player is first to align any combination of that player's game pieces and stacks of game pieces, subject to said predetermined limit, in a straight line such that the game pieces occupy at least three consecutive spaces on the playing area, wherein, for purposes of this step, a stack is considered equivalent to a game piece belonging to a player whose game piece sits atop the stack, wherein the method includes selecting the game pieces such that all of the game pieces are capable of being moved on the board and are capable of being stacked on other game pieces, subject to limitations of step (c).

2. The method of claim 1, wherein step (a) comprises selecting the playing area to be a square having 16 spaces, arranged four spaces per side.

3. The method of claim 1, further comprising selecting the predetermined limit of game pieces in a stack to be four.

* * * * *